United States Patent [19]

Mehta

[11] 4,455,817

[45] Jun. 26, 1984

[54] APPARATUS FOR THE MANUFACTURE OF A FANCY YARN

[75] Inventor: Atul Mehta, Börwang, Fed. Rep. of Germany

[73] Assignee: Saurer-Allma GmbH, Kempten, Fed. Rep. of Germany

[21] Appl. No.: 384,309

[22] Filed: Jun. 2, 1982

[30] Foreign Application Priority Data

Jun. 30, 1981 [DE] Fed. Rep. of Germany ..... 3125576

[51] Int. Cl.[3] ..... D02G 3/34; D02G 3/38; D01H 7/88

[52] U.S. Cl. ..... 57/18; 57/100; 57/104; 57/328

[58] Field of Search ..... 57/16, 104, 17, 105, 57/18, 100, 315, 328

[56] References Cited

U.S. PATENT DOCUMENTS 3,928,957 12/1975 Petrov et al. ..... 57/18

4,389,837 6/1983 Stahlecken et al. ..... 57/18 X

*Primary Examiner*—John Petrakes

*Attorney, Agent, or Firm*—Flynn, Thiel, Boutell & Tanis

[57] ABSTRACT

In an apparatus for manufacturing a fancy yarn, a rotary hollow spindle (2) carries a binding thread spool (3) and, at its discharge end, a false twist element (4). Associated with the hollow spindle (2) at the entry end are feed means having a pair (13) of delivery rolls for at least one core thread (G) and at least one fancy thread (E) which is supplied at higher speed than the core thread (G). In addition, arranged downstream of the false twist element (4) is a pair (5) of take-up rolls for taking up the finished fancy yarn at a lower speed than the supply speed of the fancy thread (E). A central drive motor (M2) drives the pair of take-up rolls (5) by way of belt drives (7, 10, 12) and the pair (13) of delivery rolls by way of a stepless control transmission (11). The feed means comprise a drawing system (S) for the fancy thread (E) comprising a pair (16) of entry rolls, a pair (17) of middle rolls and a pair (19) of exit rolls, and a separate pair (13) of delivery rolls for the core thread. A respective controllable drive motor (M1, M3) is provided for driving each of the hollow spindle (2) and the pair (19) of exit rolls, while a common, controllable drive motor (M4) is provided for the pairs (16, 17) of entry and middle rolls. Instead of using a central drive motor (M2), a respective controllable drive motor may also be provided for respectively driving the pair (5) of take-up rolls and the pair (13) of core thread delivery rolls.

6 Claims, 2 Drawing Figures

APPARATUS FOR THE MANUFACTURE OF A FANCY YARN

FIELD OF THE INVENTION

The invention relates to an apparatus for the manufacture of a fancy yarn, comprising a rotary hollow spindle which carries a binding thread spool and at its discharge side a false twist element, wherein associated with the hollow spindle at the entry side are feed means comprising a pair of delivery rolls for at least one core thread and at least one fancy thread which is supplied at a higher speed than the main thread, and also comprising a pair of take-up rolls which are arranged downstream of the false twist element and with which the finished fancy yarn is taken up at a lower speed than the feed speed of the fancy thread.

BACKGROUND OF THE INVENTION

In a known apparatus for the manufacture of a fancy or effect yarn of the above-indicated kind (DAS No. 24 39 732 which corresponds to U.S. Pat. No. 3 928 957), the core thread and the fancy thread are fed to the hollow spindle by a single pair of delivery rolls which rotate at the feed speed of the fancy thread and which permit slippage of the core thread. Upstream of the pair of delivery rolls, a brake means is associated with the core thread, on the intake side, for reducing the speed of the core thread to a speed corresponding to the take-up speed of the fancy yarn. However, that known apparatus can only be used to manufacture a very limited number of different designs.

It has also already been proposed, in an apparatus for the manufacture of a fancy yarn having a rotary hollow spindle, to use a drawing arrangement for the feed of fancy thread and a separate delivery arrangement for the feed of the core thread. In that arrangement, it was possible to alter the speeds of rotation of the individual rolls of the drawing arrangement, by way of coupling means and transmission assemblies, in order to alter the designs produced. However, such coupling means and transmission assemblies suffer from the disadvantage that they are comparatively sluggish in their reaction to control pulses and are therefore not suitable at the high delivery speeds which are achieved precisely in apparatuses of the kind set forth above.

The present invention is based on the problem of providing an apparatus for the manufacture of a fancy yarn, of the kind set forth above, which, while being of relatively simple construction, permits the production of a large number of different controlled fancy yarns, at a high production speed.

According to the invention, this is achieved in that the feed means comprises a drawing system for the fancy yarn having a pair of entry rolls, a pair of middle rolls and a pair of exit rolls, and a separate pair of delivery rolls for the core thread, which can be driven by the central motor by way of the control transmission, and that a respective controllable drive motor is provided for driving each of the hollow spindle and the pair of exit rolls, and a common controllable drive motor is provided for the pairs of entry and middle rolls, and that for driving the pair of take-up rolls and the pair of core thread delivery rolls, there is either a respective controllable drive motor of there is a central drive motor for driving the pair of take-up rolls by way of belt drives and the pair of delivery rolls by way of a stepless control transmission.

This apparatus can be used to manufacture controlled fancy yarns with a large number of possible variations, at high production speeds. This is to be attributed in particular to the fact that the apparatus has individual controllable drive motors, the speeds of rotation of which can be set independently of each other, and which also permit the desired speed of rotation to be very quickly attained. By virtue of using individual drive motors, the motors can be relatively small and are therefore quick to react.

Advantageously, toothed belts are used for transmitting power from the drive motors to the various pairs of rolls of the drawing system and from the central motor to the pairs of take-up and delivery rolls. The toothed belts are of very small moving mass, which also contributes to rapid adaptive alteration in their speed of rotation. In addition, they operate without slip in any range of rotary speed and have a low noise level and a damping effect, in comparison with gear transmissions.

The drive motors and the central motor are desirably voltage-controlled d.c. motors. In d.c. motors of that kind, the speed of rotation of the motor can be controlled from zero up to a maximum value, by electronic voltage control. In contrast to frequency-controlled motors, voltage-controlled d.c. motors are very quick in their operating reaction and operate with a low degree of slip when there is a change in speed of rotation. When the voltage is controlled down to zero, the motor follows in respect of its speed of rotation, down to a stationary condition. In contrast, frequency-controlled motors are unstable in the range close to zero, and expensive measures are required in order to stabilise the speed of rotation down to zero. Using motors, the speed of rotation of which can be controlled down to a stop gives the further advantage that the drive does not need to be separated by coupling means. There is therefore no need for mechanical coupling means which cause a large amount of inertia, particularly at a high level of switching operation, and must be regularly monitored and maintained on account of wear.

Using a controllable drive motor for the spindle drive permits sensitive matching control of the speed of rotation, over the entire speed range.

Preferably, the central motor serves as a pilot control motor and is connected to the other drive motors by way of electrical shafts in such a way that, upon a change in the speed of the central motor, the speeds of the other drive motors are changed in the same ratio. In this arrangement, the speeds of rotation of the individual drive motors can be individually controlled manually or by way of a program control. If however the speed of the pilot control motor changes, the speeds as to set at the controllable drive motors are also altered, in the same ratio. This is important for the purpose of always producing the same designs, irrespective of the speed of rotation of the central motor and thus the delivery and draw-off speed.

BRIEF DESCRIPTION OF THE DRAWINGS

The invention is described in greater detail hereinafter with reference to two embodiments which are shown in diagrammatic form in the drawings in which.

DETAILED DESCRIPTION

Figure 1:
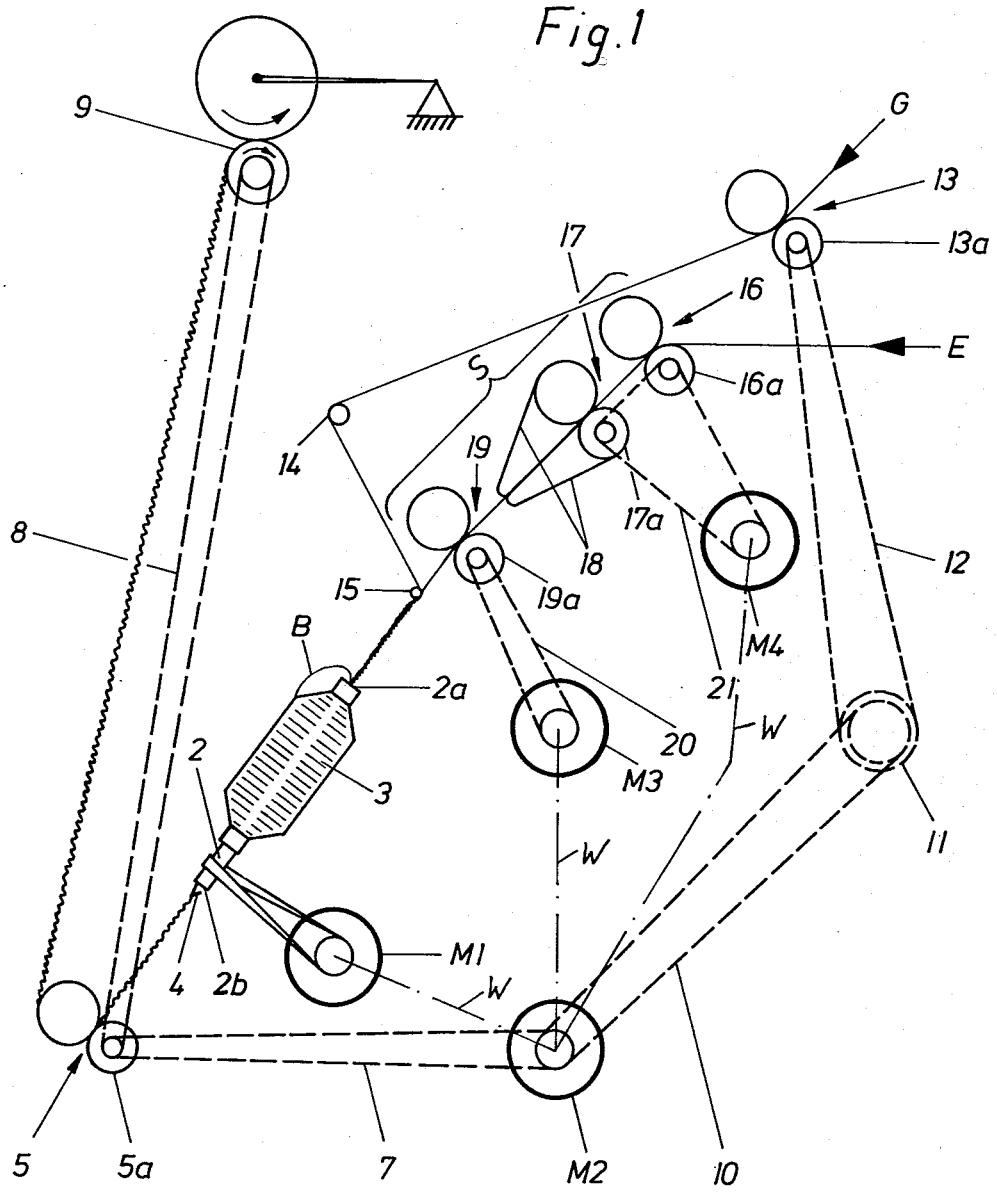
FIG. 1 shows a first embodiment.

The hollow spindle 2 is driven by the controllable drive motor M1. Disposed on the hollow spindle 2 is a binding thread spool 3. The binding thread passes into the hollow spindle 2 at the entry end 2*a*. Disposed at the exit end 2*b* of the hollow spindle 2 is a false twist element 4. Disposed downstream of the hollow spindle 2 in the direction of movement of the thread is a pair 5 of take-up rolls, of which one take-up roll 5*a* is driven by the central motor M2, by way of a toothed belt 7. A further toothed belt 8 drives the wind-on roll 9. The central motor M2 also drives a control transmission 11 which is steplessly adjustable, by way of the toothed belt 10. A further toothed belt 12 drives the roll 13*a* of the pair 13 of delivery rolls. The pair of delivery rolls 13 is provided for the feed of one or more core threads G which experience a change in direction around the thread guide means 14 and 15. The drawing system S is provided for the feed of one or more effect or fancy threads E. The drawing system S comprises the pair 16 of entry rolls, a pair 17 of middle rolls with belts 18 and a pair 19 of exit rolls. The pair of exit rolls 19 has its own controllable drive motor M3 which drives the lower roll 19*a* of the pair 19, by way of a toothed belt 20. The lower rolls 17*a* and 16*a* of the pair 17 and the pair 16 respectively are driven by way of a further controllable drive motor M4 and a toothed belt 21. By virtue of suitable selection in respect of the toothed belt pulleys and the peripheral diameters, the peripheral speed of the lower roll 17*a* of the pair 17 of middle rolls is somewhat higher than that of the lower roll 16*a* of the pair of entry rolls 16. This causes a draft effect to occur between the two pairs of rolls 16 and 17. A further draft effect may be produced between the exit of the belts 18 and the pair of exit rolls 19, said draft effect being dependent on the setting of the drive motors M3 and M4.

Depending on the manner in which the drive motors M3 and M4 are controlled, the desired design is formed by continuous or discontinuous overfeed of the fancy yarn E relative to the core yarn G. For short flames or slubs, with a high delivery speed, it is necessary to have a large change in the speed of rotation of the drawing system S, and that can be achieved by means of the separately controllable drive motors M3 and M4.

The core thread G is initially twisted with the fancy thread E on the section between the thread guide member 15 and the false twist element 4. In that section, it passes through the hollow spindle. The binding thread B which is drawn from the rotating binding thread spool also passes through the hollow spindle. As soon as those yarn components have passed through the false twist element 4, the fancy yarn is definitively formed. The twist as between the core thread G and the fancy thread E is further twisted in that operation, while the binding thread B winds around the two yarn components G and E. This winding operation is performed in the region between the false twist element 4 and the pair of take-up rolls 5. From there, the finished fancy yarn goes to the winding roll 9 where it is finally wound on to a spool.

Advantageously, the central motor M2 serves as a pilot control motor and is connected to the other drive motors M1, M3 and M4 by way of electrical shafts W in such a way that, when there is a change in the rotary speed of the central motor M2, the speeds of the other drive motors M1, M3 and M4 are also altered in the same ratio. In this connection, the speeds of the individual drive motors M1, M3 and M4 can be individually controlled manually or by way of a program control. If however the speed of the central motor M2 alters, the speeds which are so set at the controllable drive motors M1, M3 and M4 are also altered in the same ratio.

Figure 2:
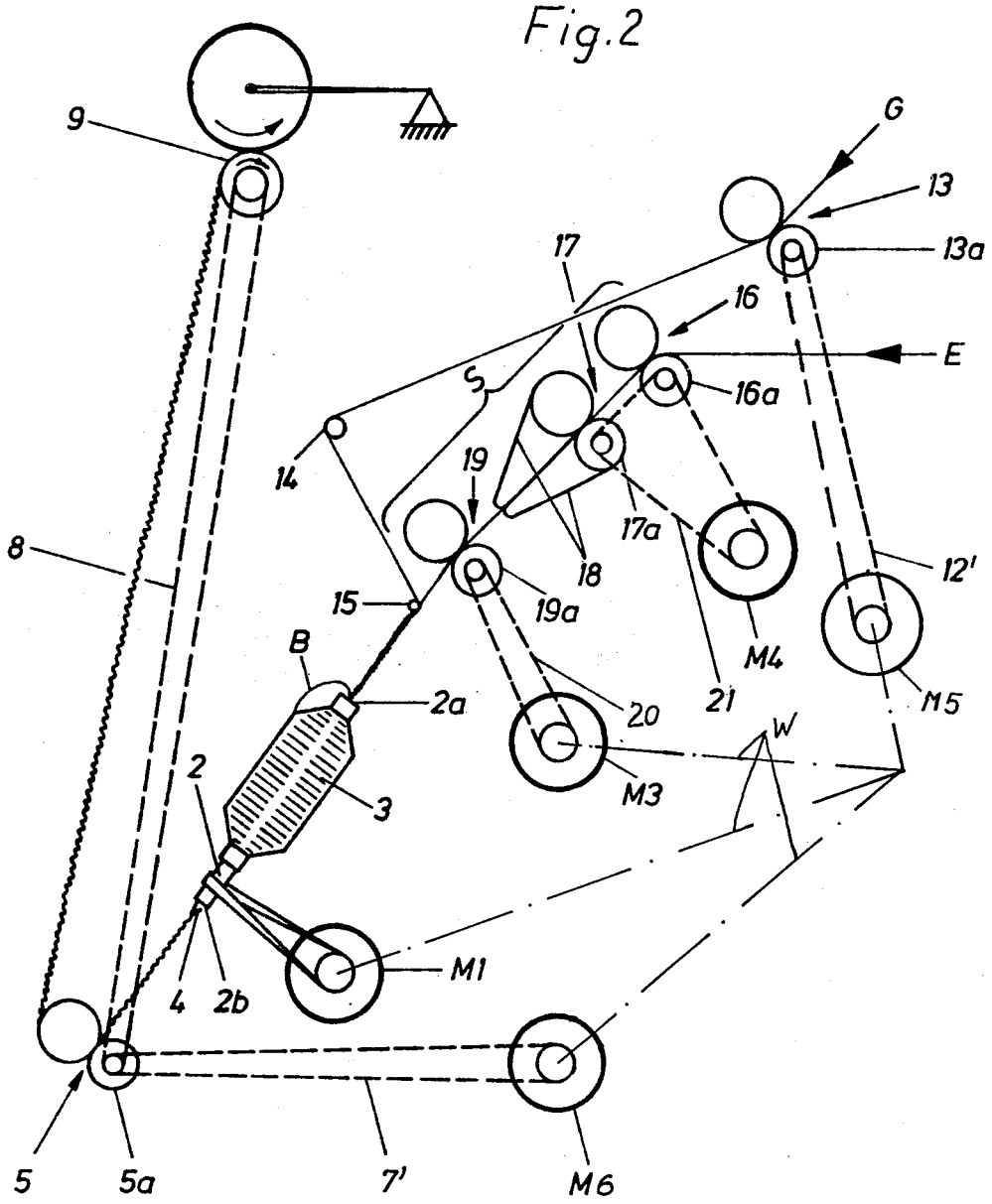
FIG. 2 shows a second embodiment.

Instead of having a central motor M2 and the transmission assembly 11, the embodiment shown in FIG. 2 has a respective controllable drive motor M5 for the pair of delivery rolls 13 for the core thread G. The drive motor M5 drives the rolls 13 by way of a toothed belt 12'. A further controllable drive motor M6 drives the pair of take-up rolls 5 by way of the toothed belt 7'. The ratio of the delivery speed of the main thread G relative to the take-up speed of the finished fancy yarn can be adjusted by controlling the drive motors M5 and M6. The other parts of the apparatus correspond to the first apparatus described above. In this embodiment also, one of the motors, for example the drive motor M5, can serve as a pilot control motor, which is then connected to the other drive motors M1, M3 and M4 and M6 by way of electrical shafts W in such a way that, when there is a change in the speed of the drive motor M5, the speeds of the other drive motors M1, M3, M4 and M6 are altered in the same ratio.

I claim:

1. In an apparatus for the manufacture of a fancy yarn, comprising a rotary hollow spindle having an entry end and a discharge end, said hollow spindle having a binding thread spool thereon and a false twist element at said discharge and, thread feed means adjacent said entry end for feeding at least one core thread and at least one fancy thread to said hollow spindle, said thread feeding means including a first drive means for effecting a faster supply of said fancy thread than said core thread, and wherein said apparatus also comprises a pair of take-up rolls adjacent said discharge and and downstream of said false twist element, said take-up rolls drawing off a finished fancy yarn at a lower speed than the feed speed of said fancy thread to said entry end of said hollow spindle, the improvement comprising wherein said thread feeding means includes a drawing means operatively engaging said fancy yarn, said drawing means having a pair of entry rolls, a pair of middle rolls and a pair of exit rolls, and a separate pair of delivery rolls for said core thread, wherein a first individual controllable drive motor is provided for driving said hollow spindle and a second individual controllable drive motor is provided for driving said pair of exit rolls, and a common controllable drive motor is provided for said pairs of entry and middle rolls, wherein said core thread delivery rolls are coupled to a central motor by a belt drive, wherein said central motor is further coupled to said pair of take-up rolls by way of a belt drive, and wherein said central motor serves as a control motor and is connected to said other drive motors through means responsive to a change in the speed of rotation of said central motor and effecting a change in the speeds of rotation of said other drive motors in the same ratio as the change in the speed of rotation of said central motor.

2. Apparatus as claimed in claim 1 in which toothed belts are provided for the transmission of power from said drive motors to the various pairs of rolls.

3. Apparatus as claimed in claim 1 in which said drive motors are voltage-controlled D.C. motors.

4. In an apparatus for the manufacture of a fancy yarn, comprising a rotary hollow spindle having an entry end and a discharge end, said hollow spindle having a binding thread spool thereon and a false twist element as said discharge end, thread feed means adjacent said entry end for feeding at least one core thread and at least one fancy thread to said hollow spindle, said thread feeding means including a first drive means for effecting a faster supply of said fancy thread than said core thread, and wherein said apparatus also comprises a pair of take-up rolls adjacent said discharge end and downstream of said false twist element, said take-up rolls drawing off a finished fancy yarn at a lower speed than the feed speed of said fancy thread to said entry end of said hollow spindle, the improvement comprising wherein said thread feeding means includes a drawing means operatively engaging said fancy yarn, said drawing means having a pair of entry rolls, a pair of middle rolls and a pair of exit rolls, and a separate pair of delivery rolls for said core thread, wherein a first individual controllable drive motor is provided for driving said hollow spindle and a second individual controllable drive motor is provided for driving said pair of exit rolls, and a common controllable drive motor is provided for said pairs of entry and middle rolls, wherein said thread feed means includes a first controllable drive motor coupled to a pair of core thread delivery rolls, wherein a second controllable drive motor is provided for driving said pair of take-up rolls, and wherein one of said first and second controllable drive motors serves as a control motor and is connected to the other drive motors through means responsive to a change in the speed of rotation of said one first and second controllable drive motor and effecting a change in the speeds of rotation of said other drive motors in the same ratio as the change in the speed of rotation of said one of said first and second controllable drive motors.

5. Apparatus as claimed in claim 4 in which toothed belts are provided for the transmission of power from said drive motors to the various pairs of rolls.

6. Apparatus as claimed in claim 4 in which said drive motors are voltage-controlled D.C. motors.

* * * * *

UNITED STATES PATENT AND TRADEMARK OFFICE

CERTIFICATE OF CORRECTION

PATENT NO. : 4 455 817

DATED : June 26, 1984

INVENTOR(S) : Atul Mehta

It is certified that error appears in the above-identified patent and that said Letters Patent is hereby corrected as shown below:

Column 4, line 30; change "and" to ---end---.

Column 4, line 36; change "and" (first occurrence) to ---end---.

Column 5, line 2; change "as" to ---at---.

Signed and Sealed this

*Fifth* Day of *March 1985*

[SEAL]

*Attest:*

DONALD J. QUIGG

*Attesting Officer* *Acting Commissioner of Patents and Trademarks*